US009689135B2

(12) United States Patent
Canney et al.

(10) Patent No.: US 9,689,135 B2
(45) Date of Patent: Jun. 27, 2017

(54) CLOSURE FOR LOCKING A COVERING

(71) Applicant: ACO Severin Ahlmann GmbH & Co. KG, Büdelsdorf (DE)

(72) Inventors: James Canney, Bedfordshire (GB); Jérôme Dubois, Louviers (FR); Didier Ollivier, Ecardenville sur Eure (FR)

(73) Assignee: ACO SEVERIN AHLMANN GMBH & CO. KG, Budelsdorf (DE)

( * ) Notice: Subject to any disclaimer, the term of this patent is extended or adjusted under 35 U.S.C. 154(b) by 25 days.

(21) Appl. No.: 14/442,511

(22) PCT Filed: Nov. 13, 2013

(86) PCT No.: PCT/EP2013/073671
§ 371 (c)(1),
(2) Date: May 13, 2015

(87) PCT Pub. No.: WO2014/076107
PCT Pub. Date: May 22, 2014

(65) Prior Publication Data

US 2016/0289913 A1 Oct. 6, 2016

(30) Foreign Application Priority Data

Nov. 14, 2012 (DE) ..... 10 2012 110 941

(51) Int. Cl.
*E05C 21/02* (2006.01)
*E02D 29/14* (2006.01)
(Continued)

(52) U.S. Cl.
CPC ..... *E02D 29/1427* (2013.01); *E01C 11/227* (2013.01); *E02B 5/085* (2013.01);
(Continued)

(58) Field of Classification Search
CPC ... E02D 29/1427; E02D 29/14; E05B 35/008; E05B 65/006; E02B 5/085; E03F 5/06; E01C 11/227
(Continued)

(56) References Cited

U.S. PATENT DOCUMENTS 1,941,589 A * 1/1934 Wellons ..... E03F 5/06 292/136
2,608,085 A * 8/1952 Castle ..... E02D 29/1427 292/169
(Continued)

FOREIGN PATENT DOCUMENTS

AU WO 2011150447 A1 * 12/2011 ..... E03F 5/06
CH EP 0337110 A1 * 10/1989 ..... E02D 29/1427
(Continued)

*Primary Examiner* — Jerry Redman
(74) *Attorney, Agent, or Firm* — Pearne & Gordon LLP

(57) ABSTRACT

Coverings for structures which can be installed in the ground are known. In order to lock the covering on the structure, closures are known which comprise a snap bolt which is designed in such a way and is mounted movably on the covering (20) against the force of a spring device in such a way that, during closing of the covering (20), the snap bolt is forced back and snaps in behind a counterbearing (14, 14') fixed to the structure in a closure position. To simplify the arrangement and also to improve durability, it is proposed that the snap bolt is mounted in a housing (40) which can be fastened in a housing receptacle of the covering (20).

20 Claims, 3 Drawing Sheets

(51) Int. Cl.

| | |
|---|---|
| ***E03F 5/06*** | (2006.01) |
| ***E05B 35/00*** | (2006.01) |
| ***E05B 65/00*** | (2006.01) |
| ***E05C 19/06*** | (2006.01) |
| ***E01C 11/22*** | (2006.01) |
| ***E02B 5/08*** | (2006.01) |

(52) U.S. Cl.
CPC ..... *E02D 29/14* (2013.01); *E03F 5/06* (2013.01); *E05B 35/008* (2013.01); *E05B 65/006* (2013.01); *E05C 19/06* (2013.01); *E02D 2300/0006* (2013.01); *E03F 2005/065* (2013.01)

(58) Field of Classification Search
USPC ..... 49/463, 465
See application file for complete search history.

(56) References Cited

U.S. PATENT DOCUMENTS 3,201,161 A * 8/1965 Castle ..... E02D 29/1427 292/165
4,113,292 A * 9/1978 Gauron ..... E05C 1/166 292/165
4,142,329 A 3/1979 Williams
6,732,555 B1 * 5/2004 Nielsen ..... E05B 17/2023 411/910
6,811,119 B1 * 11/2004 Petersen ..... E02D 29/1427 244/114 R
6,866,442 B1 * 3/2005 Petersen ..... E02D 29/1427 220/324
6,945,733 B2 * 9/2005 Rathmann ..... E03F 5/06 210/163
7,303,669 B2 * 12/2007 Monneret ..... E02D 29/1427 210/164
7,566,263 B2 * 7/2009 Snyder ..... E04F 19/083 454/284
9,347,679 B2 * 5/2016 Bruhnke ..... F24F 13/082
2010/0028077 A1 * 2/2010 Stadler ..... E02D 29/1436 404/25
2015/0300062 A1 * 10/2015 De Dominico ..... E04F 19/083 49/465

FOREIGN PATENT DOCUMENTS

DE 9411368 U1 * 9/1994 ..... E05B 35/008
DE 10-2008021669 A1 11/2009
DE 202010002763 U1 * 7/2011 ..... E03F 5/04
DE WO 2014037555 A1 * 3/2014 ..... E03F 3/046
FR WO 2010010294 A1 * 1/2010 ..... E02D 29/1427
ZA WO 2004016889 A1 * 2/2004 ..... E02D 29/1427

* cited by examiner

CLOSURE FOR LOCKING A COVERING

BACKGROUND

The invention relates to a closure for locking a cover on a structure that can be installed in the ground, and a cover designed accordingly.

For the drainage of surfaces, drainage channels are known, comprising a channel that can be installed in the ground and a cover attached to the channel, such that the drainage channel can be driven over. Further structures are point drainages or manholes, which likewise must be closed, such that they do not interfere with traffic. In any case, however, the important thing is that the attachment of the cover on the structure installed in the ground is secure.

On the other hand, it is important that the installation and the dismantling of the cover on the structure be very simple, because cleaning work is frequently necessary.

Closures for covers, or covers, respectively, are known from U.S. Pat. No. 3,201,161 or U.S. Pat. No. 1,693,190, comprising a latch, which is mounted on the cover and can move against the force of a spring, such that the snap bolt is forced back when closing the cover, and snaps in place in a closed position behind a counter bearing fixedly attached to the structure.

The known closures, and covers, respectively, however, have a very complex construction. Furthermore, the closures, and covers, respectively, are prone to corrosion, such that after a certain time in use, a proper functioning thereof is no longer ensured.

SUMMARY

The invention addresses the object of further developing a closure for locking a cover, and a cover having a closure of this type, respectively, such that, with a simple construction and a simple installation, a durable functionality is ensured.

This object is achieved by means of a closure described herein, and a corresponding cover, respectively.

This object is achieved, in particular, by means of a closure for locking a cover on a structure that can be installed in the ground, e.g. a drainage channel or a manhole, having a latch, which is designed such, and is movably mounted on the cover, against the force of a spring device, such that the snap bolt is forced back when closing the cover and snaps in place behind a counter bearing fixedly attached to the structure, wherein the latch is mounted in a housing, which can be secured in a housing receptacle in the cover. The object is also achieved by means of a cover having a closure of this type.

A substantial aspect of the invention is that the latch is no longer mounted directly in the cover and its components, but rather, a housing is provided, which, in turn, is secured in the cover. As a result, it is possible to create a closed unit, composed of a housing and the moving parts, in which the individual elements are coordinated to one another. This entire component can then, in turn, be attached to the cover.

It is possible for the housing of the latch to be open toward the bottom. As a result, the individual components of the latch, e.g. the snap bolt and compression spring, can be readily maintained or replaced. Furthermore, dirt that has infiltrated the housing falls out of the housing that is open toward the bottom, due to the gravity, when the grate is locked, and an impairment of the functioning of the latch due to contaminants in the housing is counteracted.

The housing receptacle is preferably designed as a recess in the edge of the cover, in which the housing is attached in the closed position, such that it cannot be released. The structure, i.e. the drainage channel or the manhole, which always has an edge (a frame) in structures of this type, simultaneously forms an element thereby, which secures the housing, and thus the latch in the cover.

The housing is preferably designed such that it is closed at its upper surface in the closed position. As a result, it is possible to keep substances compromising the function of the latch, any infiltration of dirt or the like, away from the latch.

The housing preferably has a retaining groove (or a retaining tongue), by means of which the housing can be fixed in a recess in the cover, which has a complementary retaining tongue (or retaining groove, respectively). The housing (and thus the latch) is thus secured in the cover in a form-fitting manner, with extremely little assembly effort.

The housing and/or the latch are preferably made of plastic. In particular, an injection molding procedure is suitable for this. As a result of this material selection, a simple production, on one hand, and a high corrosion resistance on the other hand, is ensured.

Furthermore, the housing is preferably designed such that it can be inserted in the recess in a direction of movement for the snap bolt. This means that in the closed position of the snap bolt, the housing can no longer be moved, and at the same time it is thus securely connected to the cover.

The housing preferably has a guide encompassing the latch. As a result, a securely functioning bearing of the latch is ensured over time.

The snap bolt preferably has a stop, which limits its movement in the closing direction. The latch, together with the housing, is thus comparable to a mortise lock that can be installed in a door.

Lastly, the latch preferably comprises a clamping device, by means of which the spring device can be connected to the snap bolt. As a result, it is ensured that the assembly can be assembled in a particularly simple manner.

A further substantial aspect of a closure, or a cover, respectively, of the type illustrated here lies in the operability when opening the cover. In order to simplify this, it is proposed that the housing have an engagement recess in a front region, from which the snap bolt protrudes, such that the snap bolt can be slid back to an open position by means of a tool, e.g. a screwdriver, inserted through the engagement recess from above. This engagement recess thus also directly indicates to the user where the tool is to be applied.

The housing, furthermore, preferably has an engagement bevel on its underside, beneath the snap bolt, by means of which the cover can be lifted away from the structure using a tool, e.g. a screwdriver. Thus, using the same tool, on one hand the latch can be opened, and on the hand, the opening tool is then used for lifting the cover.

The counter bearing is preferably designed as a two-piece bearing, such that a tool, e.g. a screwdriver, can be inserted between the two parts of the counter bearing, in order to engage with the snap bolt. As a result, a targeted positioning of the tool can be very easily achieved.

Furthermore, a bevel is preferably formed under the counter bearing, such that a tool, e.g. a screwdriver, which is used for opening the latch, is displaced by means of this bevel in the opening direction, when it is applied to and in contact with the bevel. The tool is thus deflected by this bevel.

In the following description, a preferred embodiment of the invention shall be explained in greater detail, based on drawings. Therein:

DETAILED DESCRIPTION OF PREFERRED EMBODIMENTS

Figure 1:
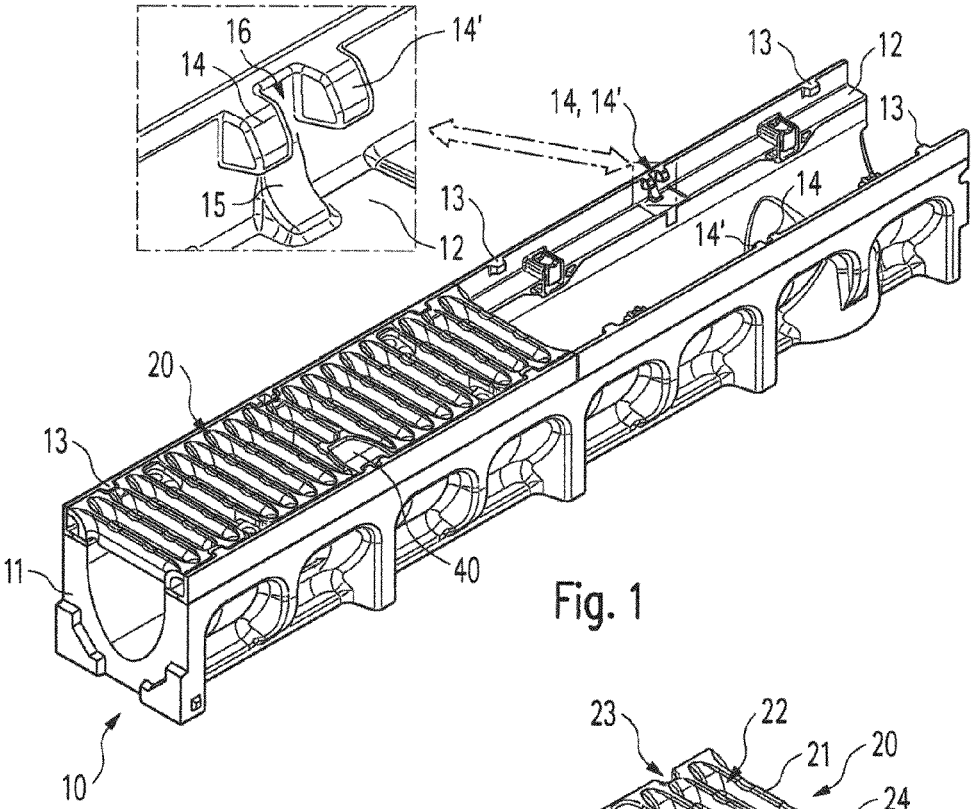
FIG. 1 shows a perspective depiction of a drainage channel with a partially applied cover.

In the following description, the same reference numerals shall be used for components that are identical and have an identical function.

Figure 2:
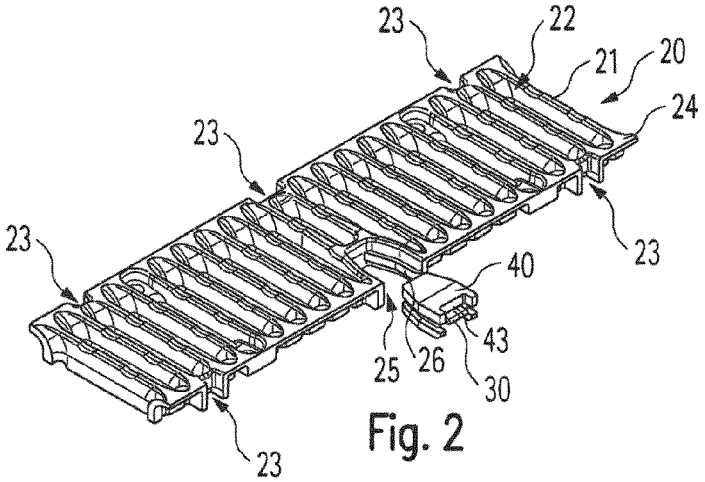
FIG. 2 shows a perspective view of the cover according to FIG. 1, diagonally from above.
Figure 3:
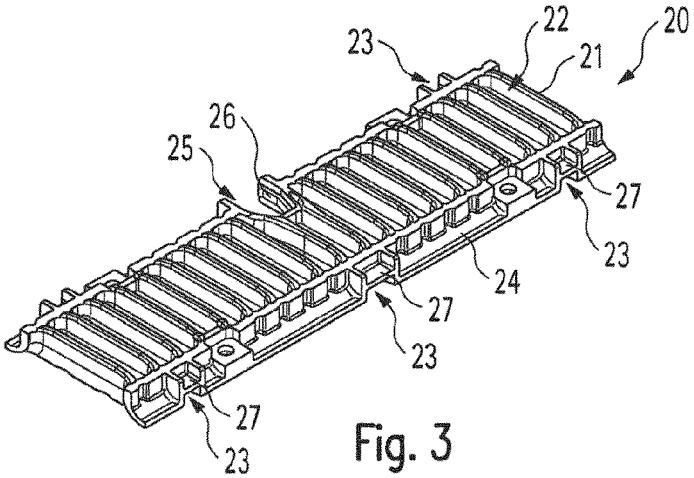
FIG. 3 shows a perspective depiction of the cover according to FIG. 1, diagonally from below.

As is shown in FIGS. 1-3, a structure that can be installed in the ground—in this case, as exemplified by a drainage channel—comprises a structure 10 having a channel body 11, the upper edge of which is formed by frames 12 in the known manner. A cover 20 is placed with the underside of its bearing surface 24 on the drainage channel 10, or between the frames encompassing it at the sides. The cover 20, in the exemplary embodiment of a drainage channel shown here, comprises channel ribs 21, between which slots 22 are formed, such that surface water can flow into the channel.

Both frames 12 of the structure 10 have an identical design. On one hand, they have lugs 13 at regular intervals, which protrude inward, and on the other hand, latch counter bearings 14, 14' are disposed between these lugs 13, which are formed as "twins" and which have a tool passage 16 between one another. A bevel 15 is provided beneath the tool passage 16, which, when a tool, e.g. a screwdriver, is inserted in the tool passage 16, then forces the front edge of the blade of the screwdriver toward the middle of the channel body 11.

The cover 20, in turn, has an asymmetrical design, and has notches 23 on one of its edges, into which the lugs 13, or the counter bearings 14, 14' fit. On one side of the cover, these notches 23 are closed by a transverse rib 27. This is shown in FIG. 3. Notch ribs 27 of this type—as shown in FIG. 2—are not provided in the notches 23 on the opposite side of the cover. As a result, when placing the cover 20 on the structure 10, it is possible to first hook the cover 20 in place, in an inclined position (relative to the longitudinal axis), with the notch ribs 27 underneath the lugs 13, or the latch counter bearings 14, 14', respectively, and then lower the cover 20 in place. As a result, the cover 20 is securely held on the corresponding frame 12, or the channel body 11, respectively, in the closed state by the lugs 13 and the latch counter bearing 14, 14' on the one side.

On the side of the cover 20 opposite the notches 23 having notch ribs 27, an enlarged recess 25 is provided opposite the central notch 23, into which a housing 40 can be inserted (inward from the outside). The housing 40 has—as is illustrated, in particular, in FIGS. 5 to 9—retaining grooves 43 on its exterior. The retaining tongues 26 corresponding to the retaining grooves are disposed in the recess 25. Thus, the housing 40 can be inserted into the recess 25 from the outer edge of the cover 20. The dimensioning in this case is carried out, such that the housing 40, once it has been inserted, is securely seated in a form-fitting and friction-locking manner in the cover 20. The housing 40 has a closed surface 46, while the underside of the housing has an insertion opening 45. Furthermore, the housing has a recess 47 on its front surface, which faces outward in the inserted state. Furthermore, this front surface is opened by a guide 44, on the lower edge of which an engagement bevel 48 is provided.

A latch 30, having a lower bevel 31 and an upper retaining surface 32, can be inserted in the interior of the housing 40. A pin-shaped spring seat 34 is attached to its inner end, opposite the bevel 31 and the retaining surface 32, beneath which a clamping tongue 35 is seated. A stop 36 is provided between the spring seat 34 and the bevel 31, or retaining surface 32, respectively, which broadens the latch 30 such that, although it can be inserted in the guide, with the bevel 31 and the retaining surface 32 protruding over the front surface of the housing into the recess 47, it does not, however, extend out of this guide 44.

Figure 4:
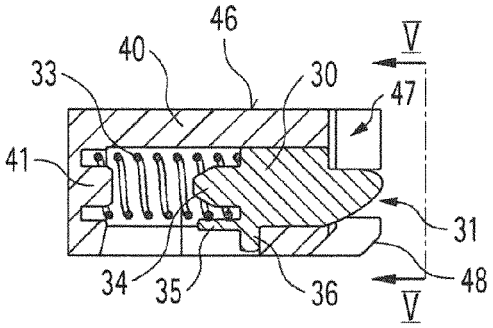
FIG. 4 shows a longitudinal section, cut through an embodiment of the closure.
Figure 7:
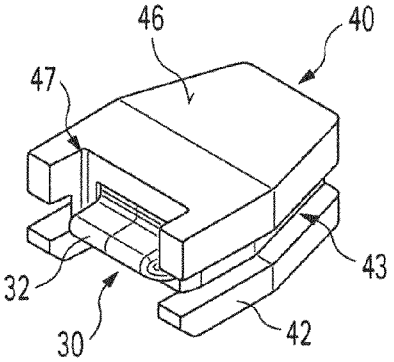
FIG. 7 shows a perspective view of a closure, diagonally from above.
Figure 5:
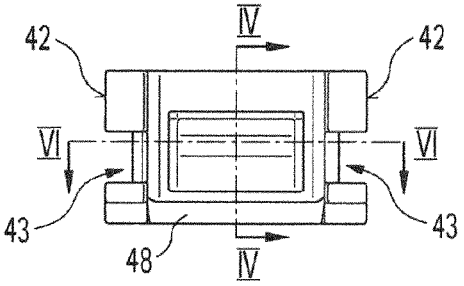
FIG. 5 shows a view of the closure along the line V-V from FIG. 4.
Figure 8:
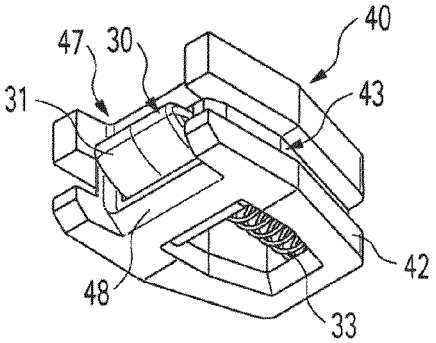
FIG. 8 shows a perspective view of the closure according to FIG. 7, diagonally from below.
Figure 6:
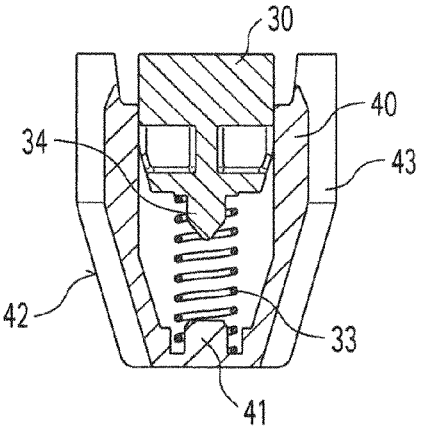
FIG. 6 shows a cut along the line VI-VI from FIG. 5.
Figure 9:
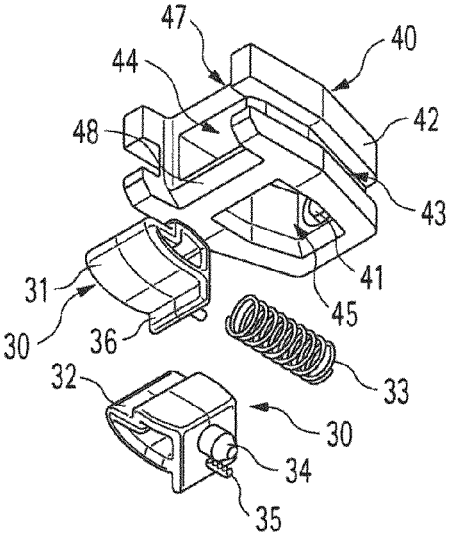
FIG. 9 shows an exploded view of the closure according to FIGS. 7 and 8, FIGS. 10A-10C show a cross-section through a cover having a closure and drainage channels corresponding to the embodiment according to FIG. 1, in various assembled positions.

A compression spring 33 can be placed on the spring seat 34 such that it is held in place on the pin-shaped spring seat 34 by the clamping tongue 35—as is shown, in particular, in FIG. 4. The end of the compression spring 33 opposite the stop 36 can be placed in a spring seat 41 in the housing 40, such that the position shown in FIGS. 4, 6 and 8 is then achieved. In this position, the compression spring 33 thus pushes the snap bolt 30 outward, such that it protrudes from the housing 40.

The placement and locking of a cover 20 on a structure 10 is described below based on FIGS. 10A to 10C and 11A to 11C.

Figure 10A:
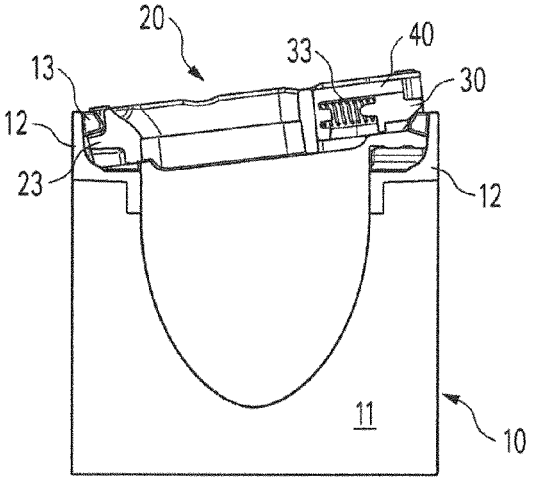
Figure 11A:
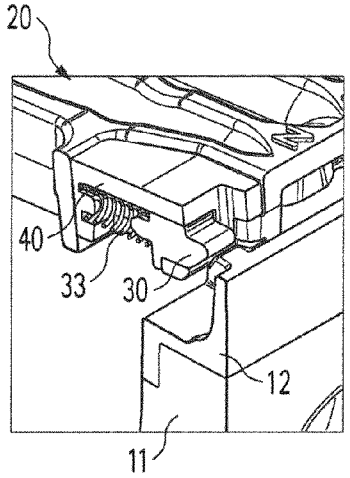
FIGS. 11A-11C show perspective partial sectional depictions corresponding to the assembled positions of the assembly according to FIGS. 10A-10C.
Figure 10B:
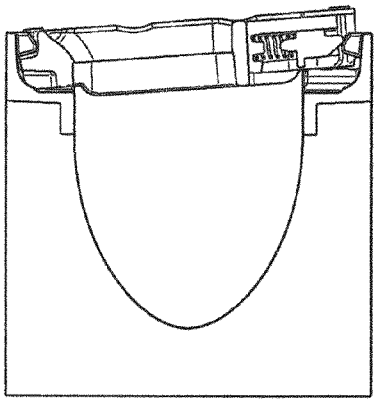
Figure 11B:
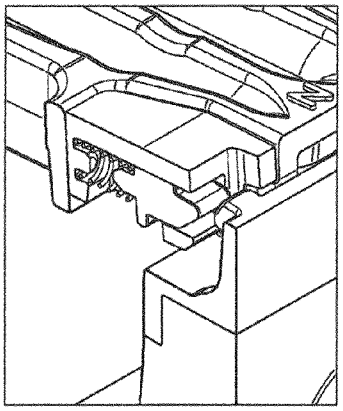
Figure 10C:
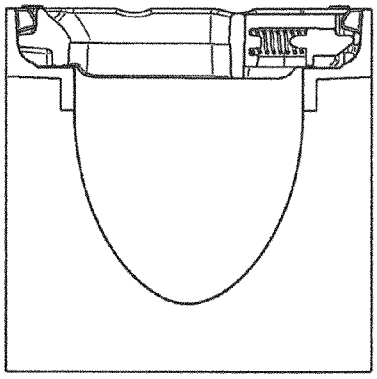
Figure 11C:
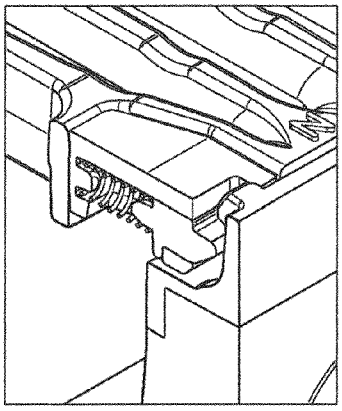

First, the cover 20 is placed at an angle on a frame 12, at its side lying opposite the recess 25, or the housing 40 with the latch 30, respectively, such that the lugs 13, or the latch counter bearing 14, 14', respectively, engage(s) in the notches 23, and the notch ribs 27 are positioned beneath the lugs 13, or the latch counter bearing 14, 14' (FIG. 10A/FIG. 11A).

When the cover 20 is then lowered, the bevel 31 engages with the likewise beveled upper surface of the latch counter bearing 14, 14' (FIG. 10B/FIG. 11B), such that the snap bolt 30 is pushed back, against the force of the compression spring 33.

Once the final position has been reached, i.e., the cover 20 rests on the corresponding frame 12, the snap bolt 30 is forced outward by the compression spring 33, such that the retaining surface 32 of the latch 30 engages with the underside of the latch counter bearing 14, 14'. Thus, the cover is then held securely on the frames 12 of the channel body 11, or securely held on the structure, respectively. The cover 20 can no longer be lifted upward in this state, because, on one hand, the notch ribs 27 are locked in place beneath the lugs 13, or beneath the latch counter bearing 14, 14', respectively. On the other hand, the lifting of the cover at the opposite side is prevented by the engagement of the retaining surface 32 of the latch 30 with the underside of the latch counter bearing 14, 14'.

In order to lift the cover, a tool, e.g. a screwdriver, is inserted between the two latch counter bearings 14, 14'. The front surface of the blade of the screwdriver then engages with the bevel 15, such that the screwdriver is forced toward the middle of the channel, as a result of which the screwdriver, in turn, pushes the snap bolt 30, against the force of the compression spring 33, into the housing 40. As a result, the retaining surface 32 is disengaged from the latch counter bearing 14, 14'. At the same time, by tilting the tool (screwdriver), the tool blade can then become engaged with the engagement bevel 43, by means of which the cover 20 can be lifted away from the frame 12. Thus, with a single tool, the latch is opened and the cover is lifted.

LIST OF REFERENCE SYMBOLS

10 structure/drainage channel
11 channel body
12 frame
13 lug
14, 14' latch counter bearing
15 bevel
16 tool passage
20 cover
21 rib
22 slot
23 notch
24 bearing surface
25 recess
26 retaining tongue
27 notch rib
30 latch (snap bolt)
31 bevel
32 retaining surface
33 compression spring
34 spring seat
35 clamping tongue
36 stop
40 housing
41 spring seat
42 lateral surface
43 retaining groove
44 guide
45 insertion opening
46 upper surface
47 recess
48 engagement bevel

The invention claimed is:

1. A kit, comprising a structure, a cover for covering the structure, and a closure for securing the cover to the structure, the closure comprising a housing, a latch, and a spring means having a spring force, the housing comprising an interior for containing the latch and the spring means and a guide for allowing the latch to partially extend outside the housing, the cover comprising a housing receptacle that the housing can be inserted into, the structure comprising two frames at edges thereof for holding the cover in a closed position, each frame comprising a counter bearing that protrudes inward, wherein the closure is adapted for locking the cover on said structure when the housing is inserted into the housing receptacle and the cover is held by the structure in the closed position, the latch being formed in such a way and movably mounted in the interior of the housing against the spring force of the spring means, so that the latch is pushed against the spring force of the spring means into the housing when closing the cover on the structure and the latch is pushed by the spring force of the spring means to a closed position such that the latch engages an underside of one of the counter bearings to lock the cover on the structure when the housing is inserted into the housing receptacle and the cover is in the closed position in the structure, characterized in that the housing is non-detachably fastened, and positively and frictionally engaged, in the housing receptacle in a direction of movement of the latch in the cover, when the housing is inserted into the housing receptacle and the cover is in the closed position in the structure.

2. The kit according to claim 1, characterized in that the housing receptacle is a recess on an edge of the cover in which the housing is secured when the housing is inserted into the housing receptacle and the cover is in the closed position in the structure, such that the housing cannot be released.

3. The kit according to claim 2, the cover further comprising a central notch on the opposite edge of the cover from the housing receptacle for engaging one of the counter bearings when the cover is in the closed position in the structure.

4. The kit according to claim 3, the central notch comprising a notch rib that engages an underside of one of the counter bearings when the cover is in the closed position in the structure.

5. The kit according to claim 4, each of the frames further comprising two lugs that protrude inward disposed on both sides of each counter bearing on each frame, the cover further comprising notches disposed on both sides of the housing receptacle and the central notch for engaging the lugs.

6. The kit according to claim 5, the notches disposed on both sides of the central notch comprising notch ribs that engage an underside of the lugs when the cover is in the closed position in the structure.

7. The kit according to claim 1, characterized in that the housing is closed at an upper surface thereof when the housing is inserted into the housing receptacle and the cover in the closed position in the structure.

8. The kit according to claim 1, characterized in that the housing or the latch are made of a plastic.

9. The kit according to claim 1, characterized in that the latch has a stop, which limits the movement of the latch in the closing direction.

10. The kit according to claim 1, characterized in that the latch comprises a clamping device, by means of which the spring means can be connected to the latch.

11. The kit according to claim 1, characterized in that the housing and the latch are made of a plastic.

12. The kit according to claim 1, wherein the structure is a drainage channel.

13. The kit according to claim 1, wherein the structure is a manhole.

14. The kit according to claim 1, wherein the structure is a point drainage.

15. A kit, comprising a structure, a cover for covering the structure, and a closure for securing the cover to the structure, the closure comprising a housing, a latch, and a spring means having a spring force, the housing comprising an interior for containing the latch and the spring means and a guide for allowing the latch to partially extend outside the housing, the cover comprising a housing receptacle that the housing can be inserted into, the structure comprising two frames at edges thereof for holding the cover in a closed position, each frame comprising a counter bearing that protrudes inward, wherein the closure is adapted for locking the cover on said structure when the housing is inserted into the housing receptacle and the cover is held by the structure in the closed position, the latch being formed in such a way and movably mounted in the interior of the housing against the spring force of the spring means, so that the latch is pushed against the spring force of the spring means into the housing when closing the cover on the structure and the latch is pushed by the spring force of the spring means to a closed position such that the latch engages an underside of one of the counter bearings to lock the cover on the structure when the housing is inserted into the housing receptacle and the cover is in the closed position in the structure, characterized in that the housing is non-detachably fastened, and positively and frictionally engaged, in the housing receptacle in a direction of movement of the latch in the cover, when the housing is inserted into the housing receptacle and the cover is in the closed position in the structure and the housing receptacle is a recess in the cover, the housing has a retaining groove or a retaining tongue, by means of which the housing can be secured in the housing receptacle, which has a complementary retaining tongue, or retaining groove, respectively.

16. The kit according to claim 15, characterized in that the housing can be inserted in the housing receptacle in a direction of movement for the latch.

17. A kit, comprising a structure, a cover for covering the structure, and a closure for securing the cover to the structure, the closure comprising a housing, a latch, and a spring means having a spring force, the housing comprising an interior for containing the latch and the spring means and a guide for allowing the latch to partially extend outside the housing, the cover comprising a housing receptacle that the housing can be inserted into, the structure comprising two frames at edges thereof for holding the cover in a closed position, each frame comprising a counter bearing that protrudes inward, wherein the closure is adapted for locking the cover on said structure when the housing is inserted into the housing receptacle and the cover is held by the structure in the closed position, the latch being formed in such a way and movably mounted in the interior of the housing against the spring force of the spring means, so that the latch is pushed against the spring force of the spring means into the housing when closing the cover on the structure and the latch is pushed by the spring force of the spring means to a closed position such that the latch engages an underside of one of the counter bearings to lock the cover on the structure when the housing is inserted into the housing receptacle and the cover is in the closed position in the structure, characterized in that the housing is non-detachably fastened, and positively and frictionally engaged, in the housing receptacle in a direction of movement of the latch in the cover, when the housing is inserted into the housing receptacle and the cover is in the closed position in the structure and a front region of the housing from which the latch protrudes, the housing has an engagement recess.

18. The kit according to claim 17, characterized in that the housing has an engagement bevel on an underside thereof, beneath the latch, by means of which the cover can be lifted from the structure.

19. The kit according to claim 17, characterized in that each counter bearing comprises two protrusions and a tool passage between the two protrusions.

20. The kit according claim 19, characterized in that a bevel is formed beneath the tool passage of each counter bearing.

* * * * *